US006289592B1

(12) United States Patent
Emerson

(10) Patent No.: US 6,289,592 B1
(45) Date of Patent: Sep. 18, 2001

(54) FOLDING KNIFE CLOSING SYSTEM

(76) Inventor: Ernest R. Emerson, 5827 Finecrest Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/514,912

(22) Filed: Feb. 28, 2000

(51) Int. Cl.[7] ..... B26B 1/04; B26B 1/10
(52) U.S. Cl. ..... 30/161; 30/155; 30/344
(58) Field of Search ..... 30/160, 161, 153, 30/330, 331, 155, 344

(56) References Cited

U.S. PATENT DOCUMENTS 5,537,750 * 7/1996 Seber et al. ..... 30/161
5,685,079 * 11/1997 Brothers et al. ..... 30/161
5,699,615 * 12/1997 Chen ..... 30/160
5,755,035 * 5/1998 Weatherly ..... 30/161
5,802,722 * 9/1998 Maxey et al. ..... 30/160
5,875,552 * 3/1999 Chen ..... 30/161
6,101,723 * 8/2000 Ford ..... 30/160
6,101,724 * 8/2000 Halligan ..... 30/161
6,105,255 * 8/2000 Cheng ..... 30/161

* cited by examiner

*Primary Examiner*—M. Rachuba
*Assistant Examiner*—Thomas J. Druan, Jr.
(74) *Attorney, Agent, or Firm*—Donn K. Harms

(57) ABSTRACT

A folding knife having improved releasable locks for holding the knife blade in an open position for use and for holding the blade in a closed position with the cutting edge housed in the knife handle. Two inner handle plates form a slot for receiving the knife edge in the closed position. One inner plate includes a first tab that is biased into the slot and is shaped to engage a flat end on the blade to prevent closing the blade until the first tab is manually pushed away from the blade end. The other inner plate includes a second tab that is biased into the slot opposite the first tab and has a small hard ball secured to the tab located so as to enter a corresponding hole in the blade when the blade is fully closed. The blade can be opened by manually rotating the blade with sufficient force to overcome the tab biasing force.

7 Claims, 1 Drawing Sheet

FOLDING KNIFE CLOSING SYSTEM

FIELD OF THE INVENTION

This invention relates to pocket knives having a blade that folds between an extended use position and a closed, blade housed, position and that include devices for releasably latching the blade in either the extended, use, position or in the closed, blade housed, position.

BACKGROUND OF THE INVENTION

A very great many types of folding pocket knives have been developed in which a blade is hinged so as to fold into a handle to cover the sharp blade edge when the knife is being carried and to be unfolded into an extended position for use. In typical folding knives the edge of the blade opposite the sharp edge is slightly exposed and includes a notch or recess for engagement by a fingernail to pull the blade from the stored to the open position.

Such knives may have one or more blades and may have other folding tools such as files, saw blades, scissors, etc. A locking device is often provided to hold the knife in the fully open, use, position and prevent the blade from accidentally folding the sharp blade edge against the user's fingers during use. A button, lever, or similar device may be provided to unlock the blade and allow it to be folded. A similar latch may be provided to releasably hold the blade in the folding position.

Knives, such as those described by Lile in U.S. Pat. No. 4,148,140 and by Sawby in U.S. Pat. No. 4,604,803, have been designed with cylindrical members that have cavities in the exterior of the member or in a sleeve in which the member rotates. A spring loaded ball engages the cavities to releasably hold the knife in an open or closed position corresponding to the cavity location. Non-adjustable coil springs are used. These rotating arrangements are complex and excessively large for a small knife.

Chen describes a knife blade locking arrangement in U.S. Pat. No. 5,875,552 that includes detents in the knife blade with a coil spring and ball arranged in the knife handle to press the ball towards a hole. As the blade is rotated, the ball will be pressed into a blade opening at the open and closed positions. In many cases the small coil spring and ball may not be sufficient to properly hold the blade in the open and closed position. The strength of the small spring is not easily adjustable and the recess for the spring in ball requires a handle of considerably thickness.

A pin mounted on a leaf spring on the exterior of a knife is shown by Jan in U.S. Pat. No. 5,093,995. The pin engages either of two notches in a blade hub to either hold the blade open or closed. To rotate the blade, the pin is pressed until a slot in the pin aligns, whereupon the blade can be pivoted. The exterior leaf spring is likely to catch on clothing when the knife is carried in a pocket or on a sheath, possible bending the spring or tearing the cloth. Further, the pin must be pressed into the knife a precise distance to assure alignment of pin and blade hub.

The knife as disclosed in my earlier U.S. Pat. No. 5,878,500 is eminently suitable for inclusion of the closed blade latch mechanism of this invention. That knife permits easy and rapid one-hand extension to the blade and locking the blade in the extended, use, position.

Thus, there is a continuing need for an improved folding knife that will be automatically latched when closed, that does not require a thick handle or a enlarged blade hub, that includes a closed blade latch that is enclosed entirely within the knife handle and that permits reasonably easy and effective adjustment of blade latching force.

SUMMARY OF THE INVENTION

The above-noted problems, and others, are overcome by a self-opening folding knife having a handle with two spaced parallel plates forming a slot between the plates, a knife blade hinged to the handle at one end for movement between an extended position for use and a closed position with the blade folded so that the sharp edge is housed in the slot.

One of the side plates is cut to form an elongated, U-shaped slit, forming a tab within the slit. One end of the tab is coextensive with the side plate and the other movable toward and away from the side plate plane. The tab is bent slightly toward the adjacent knife blade, with spring forces maintaining the tab in the slight bent configuration. A small ball is secured in a corresponding small hole near the free end of the tab. A cavity is provided in the knife blade such that when the blade is closed, the blade cavity will align with the ball with the ball pressed into the cavity by the tab. This will releasably hold the blade in the closed position.

In a preferred embodiment of a knife with which the knife blade closing system of this invention is particularly useful, a pin is formed on the blade edge opposite the sharp edge, the pin preferably extending from the blade in the general plane of the blade near the hinge. The pin is configured so as to catch on a container, such as a pants pocket, holster or the like, as the knife is withdrawn from the container to pivot the blade about the hinge to the extended position for use. The force of this withdrawal and catch of the pin is sufficient to easily overcome the retaining force of the ball and cavity arrangement. Once the ball is out of the cavity, there is little, if any, further resistance to opening the knife. Thus, this knife can be opened with one hand without any special manipulation of the knife while having sufficient force to maintain the blade in the closed position until the opening manipulation occurs.

A releasable locking means is preferably provided to lock the blade in the open position until the locking means is unlocked to permit manually folding the blade into the handle. In a preferred arrangement, the means for holding the blade in the open position comprises a second tab formed in the second plate, with the second tab biased toward the blade and lockingly encountering the blade when the blade is fully extended.

Therefore, it is an object of this invention to provide a mechanism for releasably latching a folding knife blade in a closed position with the blade housed in a slot in a handle. Another object is to provide a latching mechanism with an easily adjustable latching force. A further object is to provide a latch for releasably holding a blade in a closed position that is enclosed entirely within the knife handle and does not increase handle size. Yet another object is to provide a latch for releasably holding a blade in a closed position that does not interfere with rapid opening of a knife designed for opening with one hand.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
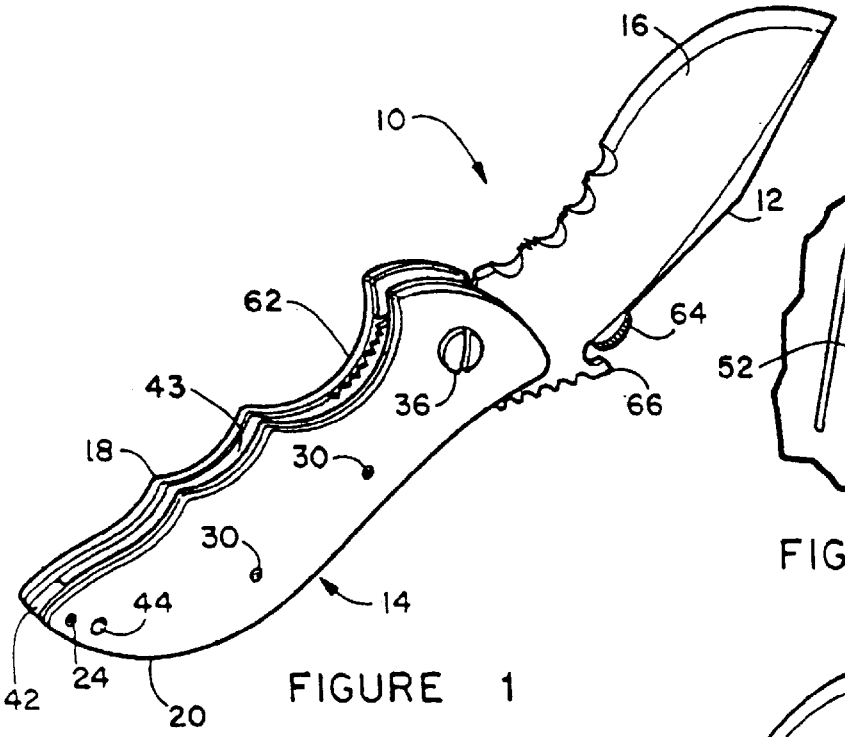
FIG. 1 is a perspective view of the self-opening knife in an open position.

Referring to FIG. 1, there is seen a folding knife 10 having a blade 12 and a handle 14 for supporting the blade in the open position for use and in a closed position in which the blade edge 16 is housed in the handle.

Figure 2:
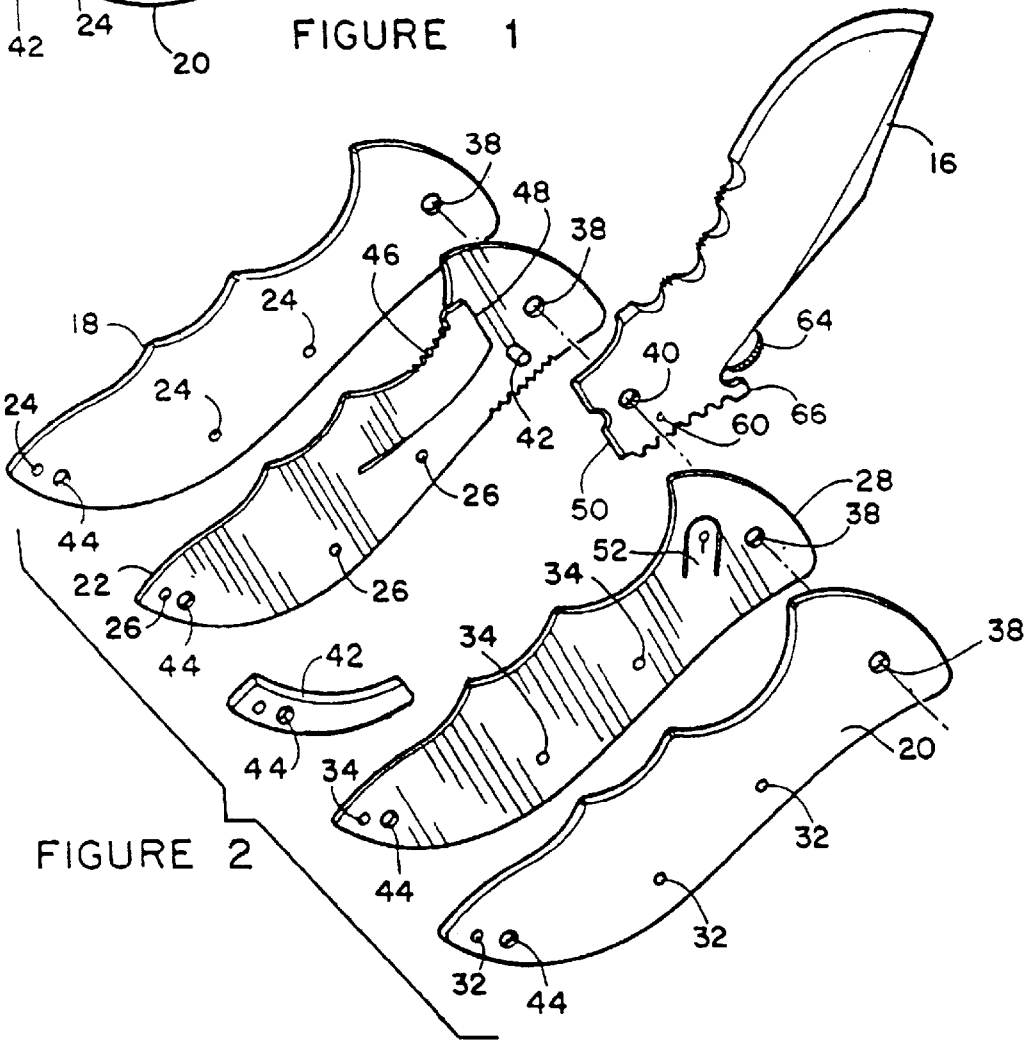
FIG. 2 is an exploded perspective view of the knife showing the components thereof.

As seen in FIGS. 1 and 2, handle 14 includes outer side plates 18 and 20 which may be formed from any suitable material such as metal or a high strength plastic, such as a polycarbonate or a filled Nylon material.

A first inner plate 22 is secured to outer plate 18 by a plurality of small bolts (not seen) passing through holes 24 in the outer plate and threaded into threaded holes 26 in the inner plate.

A second inner plate 28 is similarly secured to outer plate 20 by small bolts 30 (as seen in FIG. 1) passing through holes 32 in the outer plate and threaded into holes 34 in the inner plate. Any other suitable means may be used for securing inner plates to outer plates, such as adhesive bonding or soldering. However, bolts are preferred to allow easy disassembly of the knife for repair or cleaning.

Spacers 42 are provided at each end of the knife to space inner plates 22 and 28 apart and provide a slot 43 therebetween to house blade 12 when the knife is closed. Blade 12 pivots about a bolt 36 extending through holes 38 extending through all of the plates 18, 20, 22 and 28 and hole 40 in blade 12. A hole 44 is preferably provided though all of the plates 18, 20, 22 and 28 for fastening a lanyard or the like to the knife.

Inner plate 22 has a tab 46 cut partially from inner plate 22 and bent slightly inwardly into the space between the two inner plates. Tab 46 has a flat end 48 that engages end 50 on blade 12 to prevent the blade from inadvertently being closed during use. To close blade 12, the user inserts a finger tip into the space between inner plates 22 and 28 and moves tab 48 toward outer side plate 18, releasing blade end 50 and allowing the blade to be closed.

Figure 3:
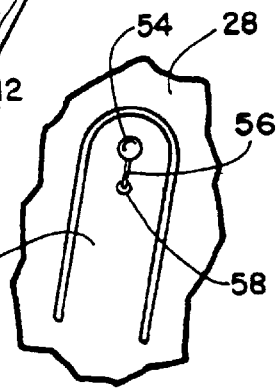
FIG. 3 is a detail view of the tab and ball arrangement for releasably holding the blade in a closed position.

Second inner plate 28 includes a small tab 52, seen in FIGS. 2 and 3, partially cut from the inner plate. Tab 52 is bent slightly to bias the tab into the space between the two inner plates. A small, hard, ball 54 is placed in a hole through the free end of tab 52. Preferably, ball 54 is held in place in a manner that does not adversely affect the hardness of the ball, as could happen if the ball were welded or soldered in place. A short slit 56 is formed integrally with the ball receiving hole. Ball 54 is placed in the hole, where it is a snug fit. Then a conical punch is used to punch a depression 58 at the end of slit 56, causing the metal along the edges of the slit to move toward and very tightly engage ball 54. While other methods, where suitable, could be used to form a projection corresponding to ball 54, this arrangement is simple, effective and provides a truly round projection and allows use of a very hard, wear resistant ball.

A cavity 60, at least partially through blade 12 is located so that when the blade is fully closed, with edge 16 fully housed in slot 43. To move blade 12 to the open position, the blade may be grasped at notch 62 (seen in FIG. 1) and pulled open, overcoming the restraining force of ball 54 engaged with cavity 60.

A small, circular, button 64 and a hook shaped projection 66 are preferably provided to aid in rapidly and automatically open blade 16 as the knife is withdrawn from a sheath or the like.

Other applications, variations and ramifications of this invention will occur to those skilled in the art upon reading this disclosure. Those are intended to be included within the scope of this invention, as defined in the appended claims.

I claim:

1. A folding knife with means for releasably retaining a blade in a closed position, which comprises:

an elongated handle having first and second ends and comprising two spaced side plates;

said side plates forming a slot for receiving a knife blade in a closed position;

a knife blade;

pivot means at one end of said knife blade for allowing rotation of said knife blade about an axis at said first handle end;

a first slit having a generally U-shaped configuration in a first of said side plates forming an elongated tab having a free end and a fixed end;

said tab having said free end overlapping a knife blade portion;

projecting means comprising a hard metal ball secured to said tab free end;

said ball being positioned in a hole through said tab, said hole including a slit integral with and extending away from said hole and said ball being held in said hole by metal dislodged when metal along said slit is deformed;

a cavity in said knife blade portion aligned with said projecting means when said knife blade is in a closed position extending at least partially between said side plates;

said elongated tab bent out of the plane of said first side plate toward said knife blade portion to bias said extension means toward and into said cavity;

whereby said knife blade is releasably latched in said closed position when said projecting means engages said cavity.

2. The folding knife according to claim 1 wherein said first slit has a generally U-shaped configuration and said projecting means is a hard metal ball secured to said tab at said free end.

3. The folding knife according to claim 1 further including means for releasably holding said blade in an open position.

4. The folding knife according to claim 3 wherein said means for releasably holding said blade in an open position comprises a slit in a second of said side plates forming a free plate edge portion flexibly biased toward a correspondingly shaped blade edge when said blade in an extended position to releasably latch said blade in said extended position.

5. A folding knife with means for releasably retaining a blade in a closed position, which comprises:

an elongated handle having first and second ends and comprising two spaced side plates;

said side plates forming a slot for receiving a knife blade in a closed position;

a knife blade;

pivot means at one end of said knife blade for allowing rotation of said knife blade about an axis at said first handle end;

a first slit in a first of said side plates forming an elongated tab having a free end and a fixed end;

said tab having said free end overlapping a knife blade portion;

a hole through said free end;

a hard metal ball positioned in said hole;

a slot having a first end communicating with said hole and extending away therefrom;

said slot deformed at a second end to force tab metal against said ball and lock said ball in said hole;

a cavity in said knife blade portion aligned with said ball when said knife blade is in a closed position extending at least partially between said side plates;

said elongated tab bent out of the plane of said first side plate toward said knife blade portion to bias said ball towards and into said cavity;

whereby said knife blade is releasably latched in said closed position when said ball engages said cavity.

6. The folding knife according to claim 1 further including means for releasably holding said blade in an open position.

7. The folding knife according to claim 3 wherein said means for releasably holding said blade in an open position comprises a slit in a second of said side plates forming a free plate edge portion flexibly biased toward a correspondingly shaped blade edge when said blade in an extended position to releasably latch said blade in said extended position.

* * * * *